US006969310B1

(12) United States Patent
Ghilardi

(10) Patent No.: US 6,969,310 B1
(45) Date of Patent: Nov. 29, 2005

(54) COMPACT VACUUM SANDER

(76) Inventor: Pierangelo Ghilardi, 833 Romany Rd., Charlotte, NC (US) 28203

( * ) Notice: Subject to any disclaimer, the term of this patent is extended or adjusted under 35 U.S.C. 154(b) by 18 days.

(21) Appl. No.: 10/867,050

(22) Filed: Jun. 14, 2004

(51) Int. Cl.[7] ..... B24B 23/00
(52) U.S. Cl. ..... 451/344; 451/75
(58) Field of Search ..... 451/344, 75, 88, 451/87, 350, 353, 354, 357, 359, 259

(56) References Cited

U.S. PATENT DOCUMENTS 6,149,506 A * 11/2000 Duescher ..... 451/59
6,315,647 B1 * 11/2001 Ghilardi ..... 451/75
6,659,844 B2 * 12/2003 Shaw ..... 451/38

* cited by examiner

*Primary Examiner*—Lee D. Wilson

(57) ABSTRACT

A sanding machine with a hand held sanding unit connected to a base unit, containing one motor that has several purposes: to provide suction of debris back to the base unit through a hose, to power a driver cable that rotates the hand-held unit and to produce vibrations needed to cause the filters to release accumulated debris, whereby three motors are not necessary as in my prior U.S. Pat. No. 6,315,647 issued on Nov. 13, 2001.

10 Claims, 6 Drawing Sheets

COMPACT VACUUM SANDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is an improvement to the sanding machine of my prior U.S. Pat. No. 6,315,647 issued on Nov. 13, 2001.

U.S. PATENT DOCUMENTS—REFERENCES CITED

U.S. Pat. No. 6,315,647 issued on Nov. 13, 2001—Pierangelo Ghilardi

FOREIGN PATENT DOCUMENTS - REFERENCES CITED

Not Applicable

BRIEF SUMMARY OF THE INVENTION

This is a complete compact system for grinding, sanding and polishing of various materials such as wood, plastic, marble, granite, sandstone, stone, drywall and metal.

The system is comprised of a base unit and a hand-held unit connected by a hose.

The base unit is powered by one single motor and has several purposes. It is a vacuum machine, it powers the hand-held unit, it can roll up and store the hose with the hand-held unit, it collects the debris, and also it can be used as a stool.

The hose has a dual purpose: it transports the debris to the base unit and contains a driver cable to power the hand-held unit.

The hand-held unit is a power tool that is operational by a driver cable.

Figure 1:
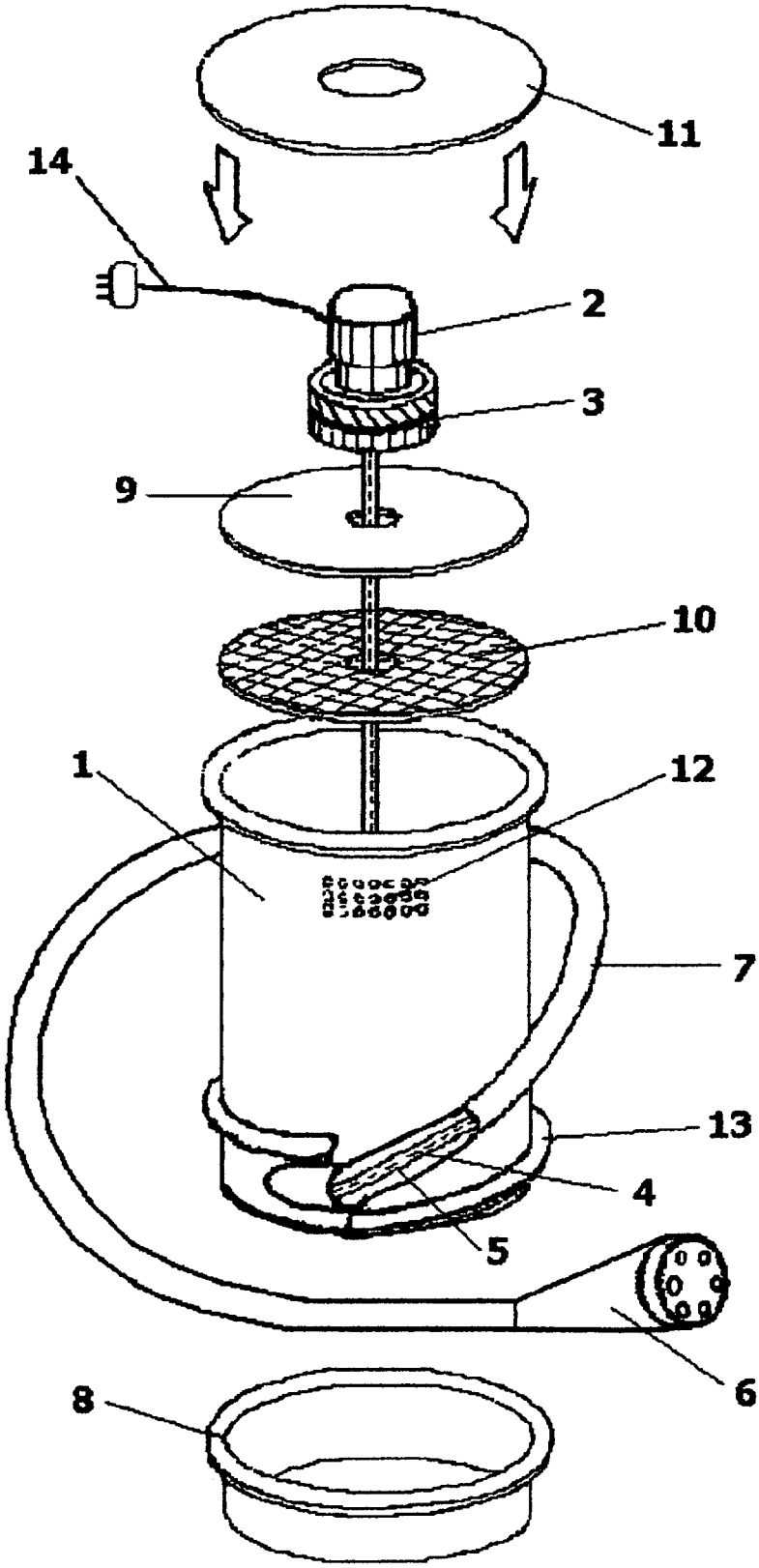
FIG. 1 Shows the compact vacuum sander.

| DRAWING REFERENCE NUMERALS | |
|---|---|
| 1 base unit | 2 electric motor |
| 3 suction fan | 4 driver cable |
| 5 sheath | 6 hand-held sanding unit |
| 7 flexible hose | 8 container |
| 9 disc | 10 filter disc |
| 11 cover | 12 holes |
| 13 one turn spiral | 14 power cord |
| 15 disc with several holes | 16 cylindrical filtration device |
| 17 inner spring | 18 outer spring |
| 19 eccentric | 20 trolley |
| 21 wheels | 22 cylinder |
| 23 cylinder sound filter | 24 disc sound filter |
| 25 perforated disc | 26 bag |
| 27 connector | 28 cover |
| 29 back support | 30 straps |
| 31 hole | |

DETAILED DESCRIPTION OF THE INVENTION

The present invention relates to a novel machine of utility in the sanding art, and more particularly to an improvement to the sanding machine disclosed in my prior U.S. Pat. No. 6,315,647 issued on Nov. 13, 2001.

Since the issuance of my above-mentioned patent, I have been working with my machine, as therein illustrated, shown and claimed, and have discovered several improvements in terms of simplifications which greatly enhance the utility of my machine and, at the same time, result in economy of construction, specifically in reducing the number of component parts necessary.

In order to understand and appreciate the improvements to which the present invention is directed, it is suggested that the text of my U.S. Pat. No. 6,315,647 is reviewed in detail so to understand the concept, and details of my original improvement to the machine in question.

The present invention is provides a machine which is easier to use for the intended purpose.

The present invention also reduces the number of parts needed in order to lower costs and reduce the total volume of a sanding system, thus allowing the realization of an inexpensive, small, high-performing unit.

The present invention also provides a simpler, more efficient combination of parts which, in particular, avoids the need of three motors.

The present invention further provides a machine which can be easily stored.

All these improvements, and others, of the present invention will become clear to those skilled in the art, after carefully studying the following detailed description along with the annexed drawings where the preferred embodiments of the present invention are shown only for purposes of illustration.

FIG. 1 shows a base unit 1 that contains one electric motor 2 that powers a suction fan 3 and a driver cable 4 that is connected to and powers a hand-held sanding unit 6. The driver cable 4 is encased in a protective sheath 5 containing a lubricating liquid, and both the driver cable 4 and its sheath 5 are contained in a flexible hose 7 that has the double purpose of housing the driver cable 4 and its sheath 5, and of transporting the debris produced during the sanding or grinding process to the base unit 1. A container 8 is positioned at the bottom of the base unit 1 and can be detached in order to discard the collected debris. A disc 9 is positioned horizontally inside the base unit 1 in order to hold the motor 2 and suction fan 3, and a filter disc 10 is positioned horizontally inside the base unit below disc 9 to prevent accumulation of debris on the motor 2 and on the suction fan 3. A cover 11 is positioned on top of the base unit 1. Several holes 12 are drilled in the base unit 1 between disc 9 and cover 11 for exhausting air. A one turn spiral 13 is positioned around the bottom of the base unit 1 to help the hose 7 to be rolled up properly. A power cord 14 is connected to the motor 2.

Figure 2:
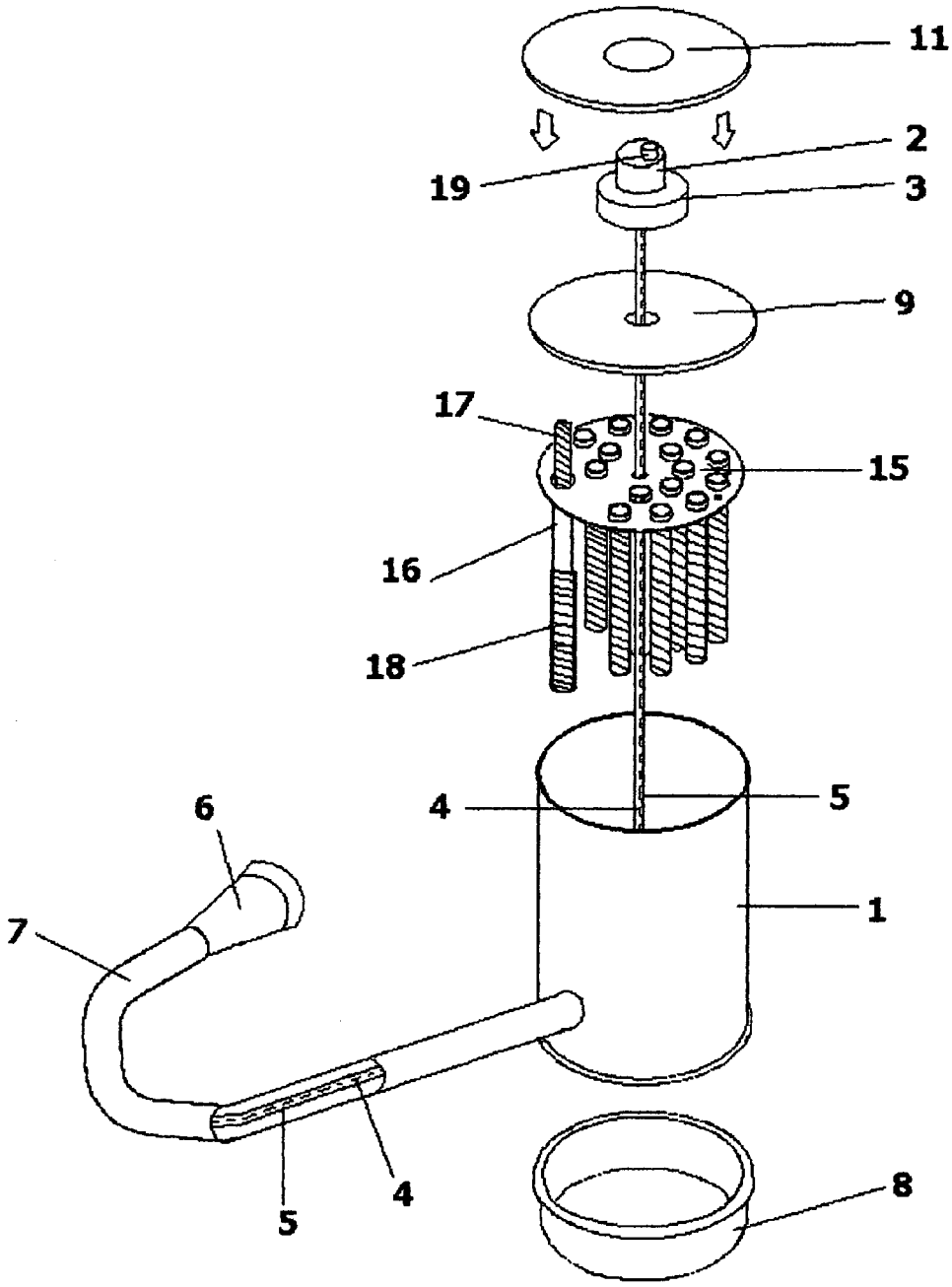
FIG. 2 Shows the compact vacuum sander with self cleaning filters.

FIG. 2 shows a base unit 1 that contains one electric motor 2 that powers a suction fan 3 and a driver cable 4 that is connected to and powers a hand-held sanding unit 6. The driver cable 4 is encased in a protective sheath 5 containing a lubricating liquid, and both the driver cable 4 and its sheath 5 are contained in a flexible hose 7 that has the double purpose of housing the driver cable 4 and its sheath 5, and of transporting the debris produced during the sanding or grinding process to the base unit 1. A container 8 is positioned at the bottom of the base unit 1 and can be detached in order to discard the collected debris. A disk 9 is positioned horizontally inside the base unit 1 in order to hold the motor 2 and the suction vacuum fan 3. A disk with several holes 15 is positioned horizontally inside the base unit 1 below disc 9, and cylindrical filtration devices 16 are inserted in each hole of disc 15. Each cylindrical filtration device 16 contains an inner spring 17 and is inserted in an outer spring 18. An eccentric 19 is positioned in an eccentric position on top of the motor 2 on the same axis of the suction fan 3 and the cable 4. The purpose of the eccentric 19 is to induce the motor 2 to produce minimal vibrations needed to lightly shake the disc 9 and consequently the base unit 1, the disc with several holes 15, the inner springs 17, and the outer springs 18. The vibrations of the inner springs 17 and the outer springs 18 on the cylindrical filtration devices 16 cause the debris to fall into container 8 for later disposal, and keep the cylindrical filtration devices 16 clean. A cover 11 is positioned on top of base unit 1.

Figure 3:
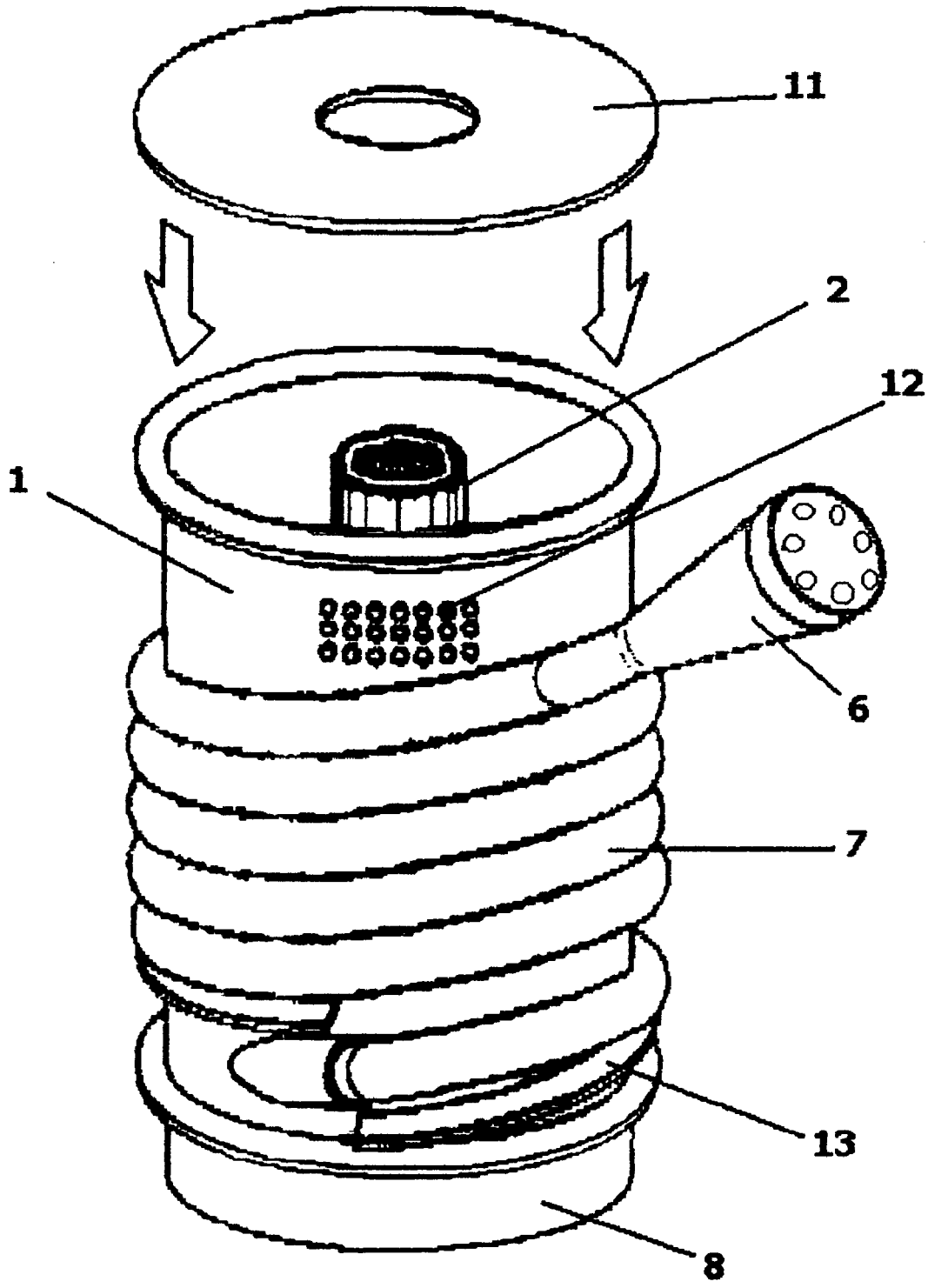
FIG. 3 Shows the compact vacuum sander with the hose in a rolled up position.

FIG. 3 shows the compact vacuum sanding machine with the hose 7 rolled up for easy storage on the base unit 1 guided by the one turn spiral 13.

Figure 4:
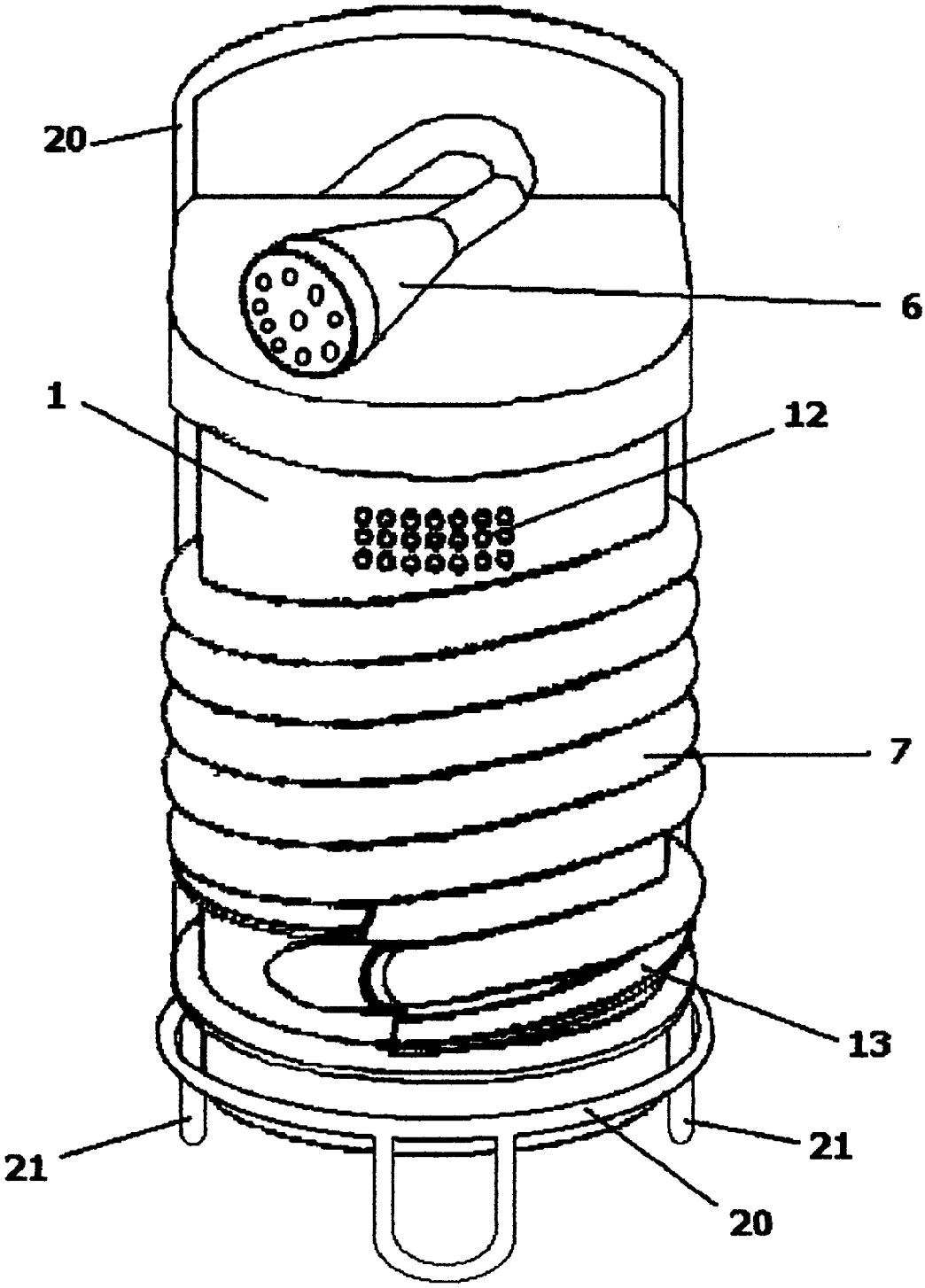
FIG. 4 Shows the compact vacuum sander mounted on a trolley.

FIG. 4 shows the compact vacuum sanding machine mounted on a trolley 20 with the hose 7, guided by the one turn spiral 13, rolled up for easy storage on the base unit 1. The trolley 20 has two wheels 21 for carrying along the compact vacuum sanding system.

Figure 5:
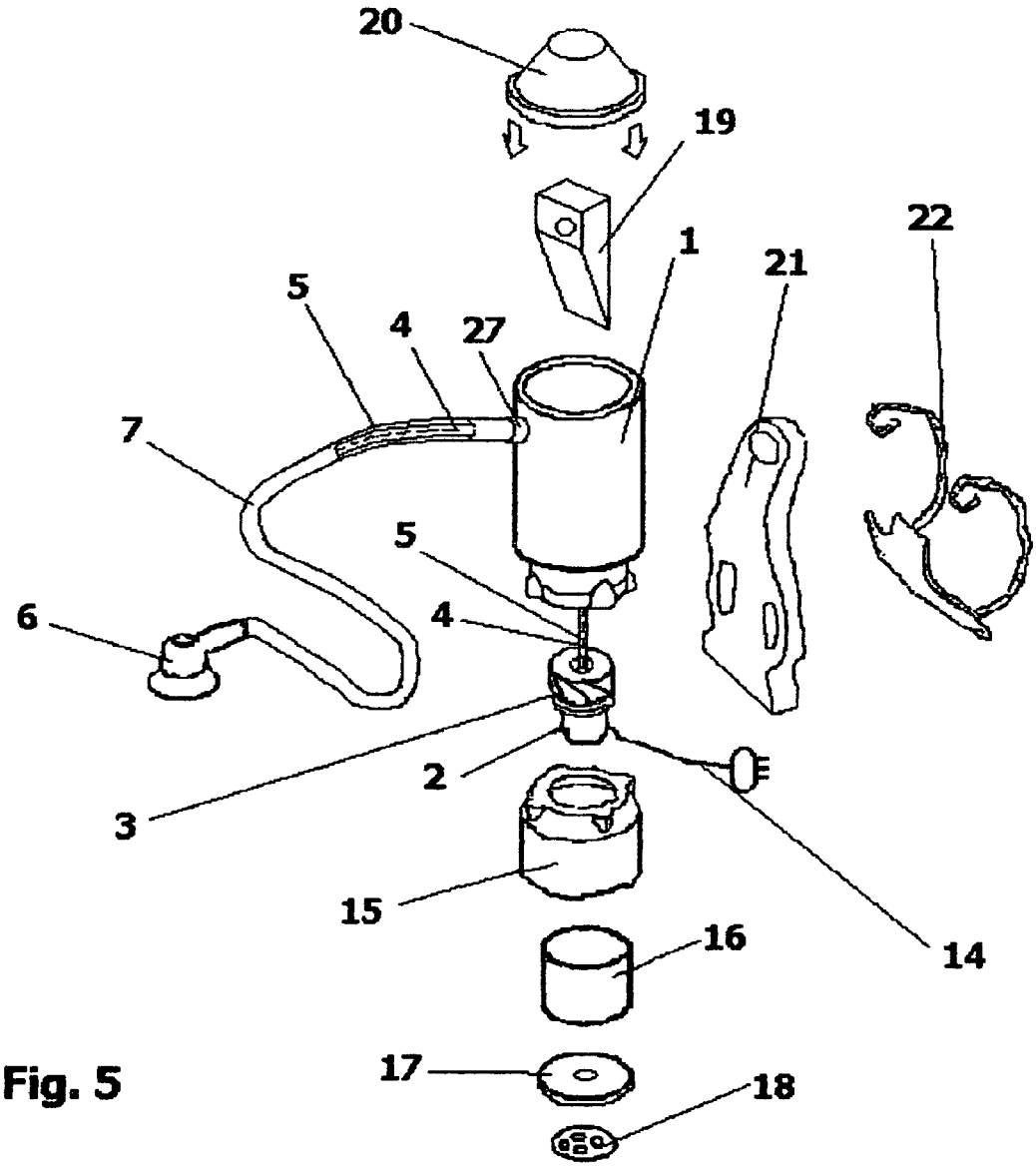
FIG. 5 Shows the backpack version of the compact vacuum sander.

FIG. 5 shows one base unit 1 that contains one electric motor 2 that powers a fan 3 and a driver cable 4 that is connected to and powers a hand-held sanding unit 6. The driver cable 4 is encased in a protective sheath 5 containing a lubricating liquid, and both the driver cable 4 and its sheath 5 are contained in a flexible hose 7 that has the double purpose of housing the driver cable 4 and its sheath 5, and of transporting the debris produced during the sanding or grinding process to the base unit 1. A cylinder 22 is positioned at the bottom of the base unit 1 as a support of the motor 2 and suction fan 3, and contains a cylinder sound filter 23 and a disc sound filter 24. A perforated disc 25 is the bottom of the cylinder 22 for exhausting air. A bag 26 is inside base unit 1, and is connected to hose 7 with the purpose of collecting the debris produced during the sanding or grinding process. The bag 26 can be emptied or replaced once it is full of debris. A connector 27 connects the hose 7 to bag 26 through base unit 1. A cover 28 covers the base unit 1. An ergonomic back support 29 is attached to base unit 1 and straps 30 are attached to the back support 29 in order to allow the compact vacuum sander to be carried around easily as a backpack. A power cord 14 is connected to the motor 2.

Figure 6:
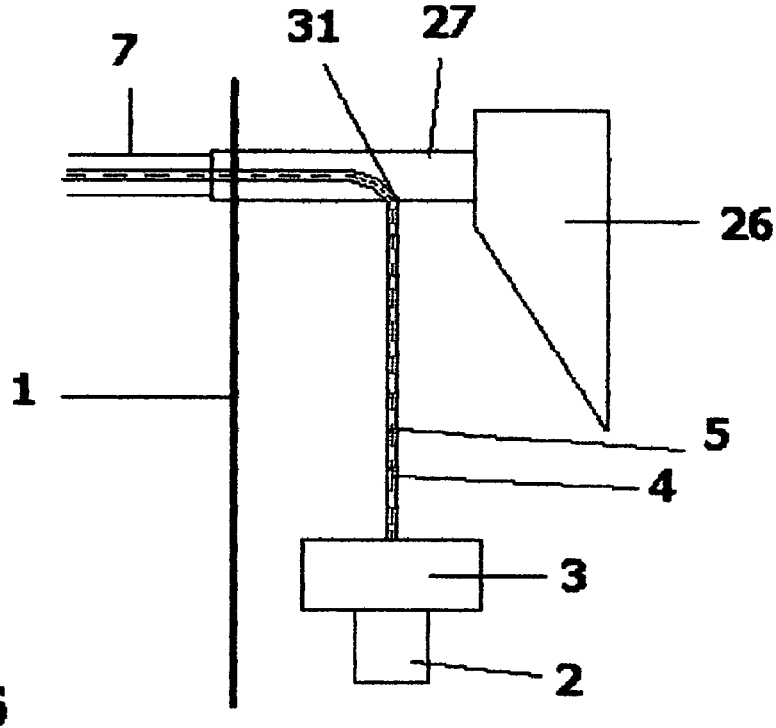
FIG. 6 Shows details of the connector for the backpack vacuum sander.

FIG. 6 shows the detail of connector 27 connecting the hose 7 to the bag 26 through base unit 1. A hole 31 is on the bottom of connector 27 to allow the driver cable 4 and its sheath 5 connect to motor 2 and suction fan 3.

Figure 6A:
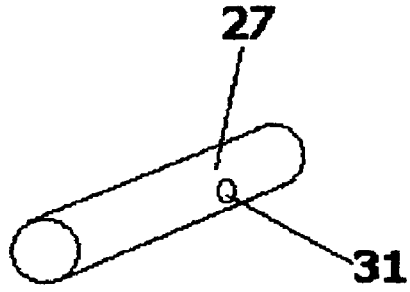
FIG. 6*a* Shows details of the connector for backpack vacuum sander.

FIG. 6*a* shows the detail of connector 27 with hole 31.

It should now be clear to those skilled in the art that using only one motor to power the whole compact vacuum sander will reduce the consumption of power, the number of parts needed and it will reduce the total volume of a sanding system.

Furthermore, having the motor, the fan, the driver cable, and the tool all assembled on the same axis will considerably reduce the number of parts needed while, at the same time, improving the cooling of the mechanical parts involved in the operation of the sanding system.

In addition, being able to roll up and store the flexible hose around the base unit will reduce the chances of breakage and facilitate the storage while increasing work area safety by leaving less hose on the floor. This eliminates a tripping hazard and reduces the chance of damage to the hose itself.

The possibility of having the compact sanding unit mounted as a backpack also increases the safety of the work area for the same reasons: it eliminates a tripping hazard and reduces the chance of damage to the hose itself.

Although the description above contains many specificities, these should not be construed as limiting the scope of the invention, but merely to provide illustrations of some of the presently preferred embodiments of this invention. Various other embodiments and ramifications are possible within its scope. Thus the scope of the invention should be determined by the appended claims and their legal equivalents, rather than by the examples given.

I claim:

1. A sanding machine comprising:

a. a base unit which is a collection receptacle for debris, b. one motor which is housed inside said base unit and powers, simultaneously and on the same axis, a suction fan and a driver cable, wherein said suction fan provides suction for the debris and said driver cable is encased in a protective sheath containing lubricating fluid, c. a hand-held unit which is powered by said driver cable and is connected to said base unit by means of a hose that has a dual purpose of containing said driver cable, and of transporting the collected debris to the base unit.

2. A sanding machine as described in claim 1, wherein said base unit can also rotate, and roll up around itself said hose for storage.

3. A sanding machine as described in claim 1, wherein said base unit also contains filters and an eccentric is mounted on said motor to produce minimal vibrations in order to lightly shake said base unit and to cause filters to release debris.

4. A sanding machine as described in claim 1, wherein said base unit also contains a disc having several holes and cylindrical filtration devices adhered thereto, wherein said cylindrical filtration devices have a spring as their inner core and are encased by a second spring of larger diameter, and wherein an eccentric is mounted on said motor to produce minimal vibrations in order to lightly shake said base unit and cause said cylindrical filtration devices to release accumulated debris.

5. A sanding machine as described in claim 1, wherein said base unit is incorporated in a backpack.

6. A sanding machine as described in claim 1, wherein said base unit is also a backpack.

7. A sanding machine as described in claim 1, wherein said base unit is mounted on a portable trolley.

8. A sanding machine as described in claim 1, wherein said base unit and its cover are made of hard material and can be used as a stool.

9. A sanding machine as described in claim 1, wherein the hand-held sanding unit has interchangeable heads.

10. A sanding machine as described in claim 1, wherein the hand-held unit is a rotating brush functional to cleaning purposes.

* * * * *